US007496207B2

(12) United States Patent
Borgonovo

(10) Patent No.: US 7,496,207 B2
(45) Date of Patent: Feb. 24, 2009

(54) CABINET FOR AUDIO DEVICES

(75) Inventor: Alberto Borgonovo, Hong Kong (HK)

(73) Assignee: Thomson Licensing, Boulogne Billancourt (FR)

( * ) Notice: Subject to any disclaimer, the term of this patent is extended or adjusted under 35 U.S.C. 154(b) by 739 days.

(21) Appl. No.: 09/836,637

(22) Filed: Apr. 17, 2001

(65) Prior Publication Data

US 2001/0031059 A1 Oct. 18, 2001

(30) Foreign Application Priority Data

Apr. 18, 2000 (EP) ..... 00108438

(51) Int. Cl.
*H04R 1/02* (2006.01)
*H04R 1/00* (2006.01)

(52) U.S. Cl. ..... 381/335; 381/334; 381/388

(58) Field of Classification Search ..... 381/334, 381/333, 332, 300, 306, 388, 386, 335, 336, 381/395, 383; 181/182, 185, 186, 199, 153; 348/E5.13; 455/350

See application file for complete search history.

(56) References Cited

U.S. PATENT DOCUMENTS

| | | | | |
|---|---|---|---|---|
| 3,473,625 | A * | 10/1969 | Heisrath | 381/336 |
| 3,987,258 | A * | 10/1976 | Tsutsui et al. | 381/334 |
| 4,572,325 | A * | 2/1986 | Schupbach | 181/199 |
| 5,274,709 | A * | 12/1993 | Koizumi | 381/306 |
| 5,361,380 | A * | 11/1994 | You et al. | 381/333 |
| 5,689,574 | A * | 11/1997 | Heirich et al. | 381/332 |
| 6,335,974 | B1 * | 1/2002 | Kunimoto | 381/306 |
| 6,415,036 | B1 * | 7/2002 | Ritter | 381/388 |
| 6,526,150 | B2 * | 2/2003 | Kelly et al. | 381/386 |

FOREIGN PATENT DOCUMENTS

| | | | |
|---|---|---|---|
| DE | 10 76 184 | B | 2/1960 |
| GB | 2303485 | * | 2/1997 |
| GB | 2349036 | * | 10/2000 |
| JP | 01 064191 | | 3/1989 |

* cited by examiner

*Primary Examiner*—Brian Ensey
(74) *Attorney, Agent, or Firm*—Joseph J. Laks; Harvey D. Fried; Patricia Verlangieri

(57) ABSTRACT

The present invention is related to a cabinet for consumer electronic devices equipped with loudspeakers. Examples for such devices are audio equipment like CD players, tape recorders, radios, and television receivers. In particular, the invention is related to devices where the loudspeakers form an integral part of it.

The manufacturing of the cabinet as an integral part by injection molding of their sticks requires a molding tool for each type of cabinet. However, for marketing reasons it is necessary to be able to present a serious of one type of devices, e.g. portable audio devices distinguishing over each other in the design. This causes increased manufacturing costs due to the need for individual molding tools for each individual cabinet. The present invention suggests a cabinet for consumer electronic devices comprising a main cabinet for housing electrical and mechanical components of the electronic device and further comprises a cabinet for a loudspeaker wherein the main cabinet and the loudspeaker cabinet are separate individual parts being connected in the factory in a non-detachable manner. In this way it is possible to provide different designs for an electronic device, which are based on an identical main cabinet. Thereby the invention significantly reduces manufacturing costs compared to conventional cabinets for audio devices.

7 Claims, 3 Drawing Sheets

CABINET FOR AUDIO DEVICES

FIELD OF THE INVENTION

The present invention is related to a cabinet for consumer electronic devices equipped with loudspeakers. Examples for such devices are audio equipment like CD players, tape recorders, radios, and television receivers. In particular, the invention is related to devices where the loudspeakers form an integral part of it.

BACKGROUND OF THE INVENTION

In known electronic devices of this type, the cabinet is formed as an integral part for housing electronic and mechanical components as it is shown in FIGS. 1*a* and 1*b*. The electrical components comprise among others the power supply and signal processing circuits. The mechanical components may be a tape recorder and/or a CD player. The housing acts as a structuring element apt for arranging all required components for the device. Furthermore, the housing protects the user from hazardous electrical shocks and the components from damages due to external influences like dirt or moisture. Finally, the cabinet allows designing the device, i.e. the shape, size and looking. For all this reasons the cabinet is a very important part of the device, sometimes decisive for its commercial success.

In general, the cabinet is made out of plastic by injection moulding. Known cabinets enclose all components especially the loudspeakers. For marketing purposes it is frequently required to have different models of different design and size for different markets. It is therefore necessary to manufacture different types of cabinets for devices having different types of loudspeakers or different design of the loudspeaker boxes. Even though the mechanical and electrical components can be identical. This type of differentiation causes significant costs due to different moulds required for manufacturing cabinets for different models.

SUMMARY OF THE INVENTION

Using this as a starting point the present invention suggests a cabinet for an electronic device equipped with a loudspeaker for audio reproduction. Today audio devices have usually two loudspeakers for stereo reproduction of sound. However, the number of loudspeakers is not important for the present invention. The cabinet comprises a main cabinet for housing electrical and mechanical components of the electronic device and further comprises a cabinet for a loudspeaker being separate from the main cabinet and connected to the outside of the main cabinet in an non-detachable manner.

In this way the present invention allows to design audio devices with different look without requiring completely individual cabinets. Rather the invention suggests to use a standardized main cabinet to take advantage of a more cost efficient manufacturing.

In an embodiment of the invention a vibration damping means is arranged between the main cabinet and the loudspeaker cabinet. The vibration damping means improve the sound quality but also prevent dust or moisture from penetrating into the loudspeaker cabinet.

It is also possible to arrange electronic circuitry inside the loudspeaker cabinet, if certain loudspeakers need different circuits than others. This allows an even higher degree of standardization, encompassing not only the cabinet itself but also the electrical components, in particular those related to the sound reproduction.

In yet another embodiment of the invention the main cabinet is provided with urging means pressing the loudspeaker cabinet against the main cabinet to secure a tight seat of the loudspeaker cabinet on the main cabinet.

This advantage can also be achieved if the urging means press the loudspeaker cabinet primarily against the vibration damping means.

It is understood that even though the resent invention is exemplified as a portable audio device the scope of the invention is not limited to this kind of devices. The invention can be applied to any consumer electronics products equipped with loudspeakers, e.g. TV receivers.

BRIEF DESCRIPTION OF THE DRAWINGS

In the drawing an embodiment of the present invention is illustrated wherein equal or corresponding elements are denoted with the same reference number. The figures are showing.

DETAILED DESCRIPTION OF PREFERRED EMBODIMENTS

Figure 1A:
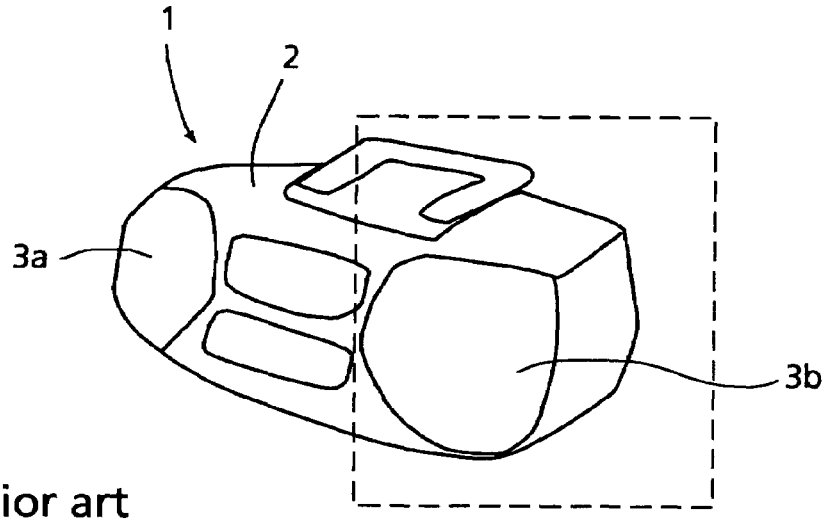
Prior art Fig.1a
FIGS. 1*a* and 1*b* a portable audio device according to the prior art.
Figure 1B:
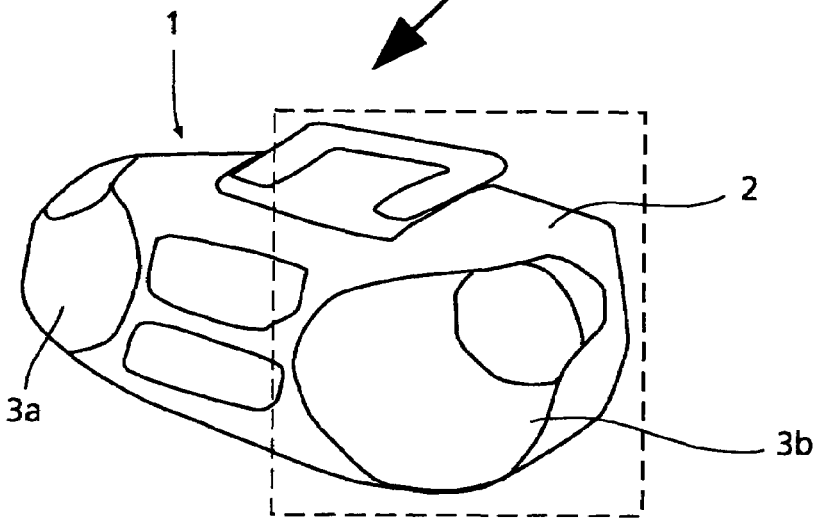
Prior art Fig.1b

FIG. 1*a* shows a portable audio device 1 of a conventional type having for example a radio receiver, a tape recorder and a CD player. The components are contained in a cabinet 2 made out of injection moulded plastic. The device 1 is equipped with two sets of loudspeakers 3*a*, 3*b* on the left and on the right side of the cabinet 2 for stereo representation of the sound. By comparison of FIGS. 1*a* and 1*b* it can be seen that the device shown in FIG. 1*b* the loudspeaker cabinets are larger compared to the device shown in FIG. 1*a*. The design shown in FIG. 1*b* gives the user the impression that this device is more powerful than the one shown in FIG. 1*a* even if the two devices are technically identical apart from the loudspeakers and/or the loudspeaker cabinet. This kind of differentiation is frequently required for marketing purposes to enable a manufacturer to satisfy different segments of the market. However, this kind of differentiation gives rise to increased manufacturing costs for the different types of cabinets.

Figure 2A:
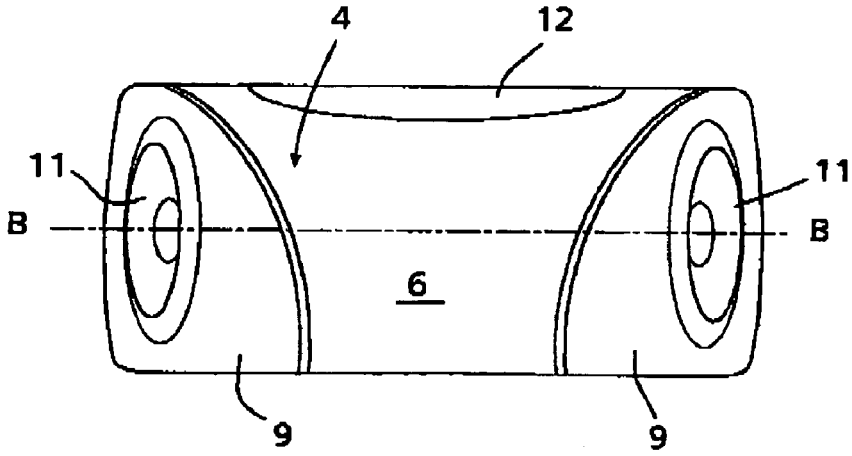
FIG. 2*a* a first audio device according to the present invention in front view.
Figure 2B:
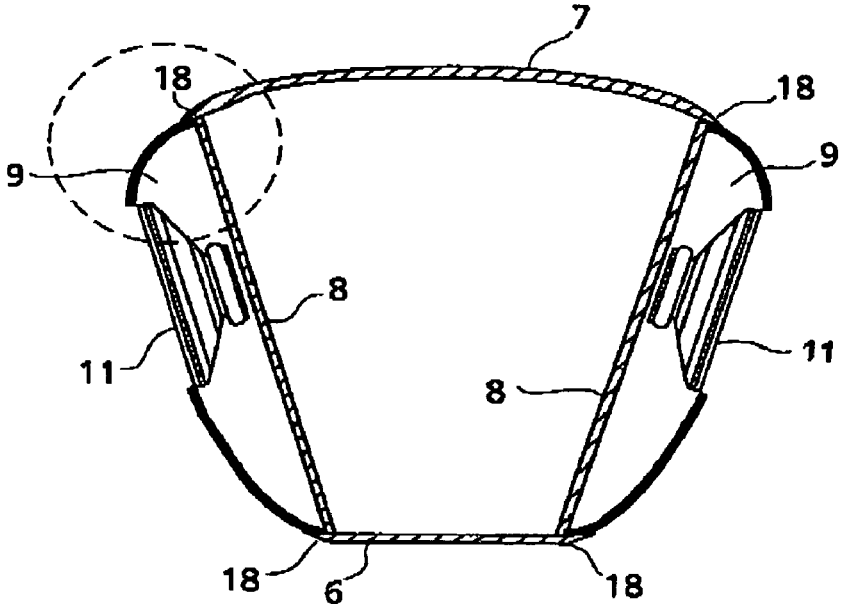
FIG. 2*b* the audio device of FIG. 2*a* in a sectional view.

In FIGS. 2*a* and 2*b* a portable audio device 1 according to the present invention is shown in a front view. The cabinet of this device comprises a main cabinet 4 which is manufactured in a conventional way, e.g. by injection moulding of plastic material. The main cabinet 4 incorporates a front wall 6 and a back wall 7 (FIG. 2*b*). The front and the back walls are connected by sidewalls 8 (FIG. 2*b*). Attached to the main cabinet 4 there are two loudspeaker cabinets 9 on each side of the main cabinet 4. It is important to note that the loudspeaker cabinets 9 are separate parts from the main cabinet and are attached to the latter by clipping means, screws or any other technique that is known in the prior art for connecting plastic form parts. Each loudspeaker cabinet 9 houses a loudspeaker 11 for the reproduction of audio signals reproduced by a CD player, tape recorder or radio receiver incorporated in the main cabinet 4. For the sake of simplicity only the CD door 12 is shown in FIG. 2*a*. The electrical connection between the loudspeakers 11 and the signal processing and amplifying circuits are made by conventional plug connections or simply by wires penetrating the sidewalls 8 of the main cabinet 4.

Figure 2C:
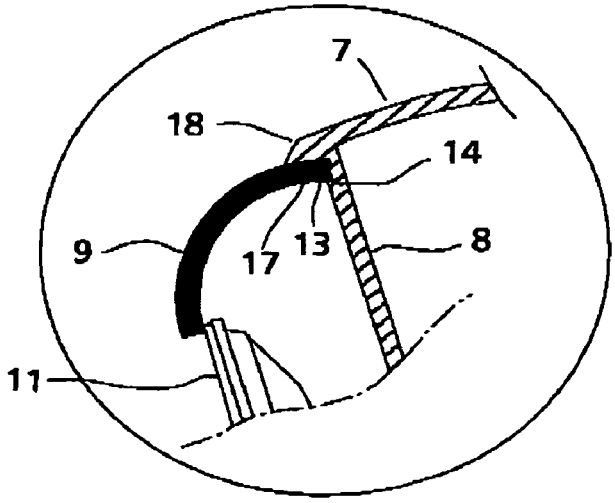
FIG. 2*c* details of the device shown in FIG. 2*a;*

FIG. 2*c* shows an enlarged detail of FIG. 2*b* and in particular, the contact area between the loudspeaker cabinet 9 and the main cabinet 4. Between the plastic parts of the two cabinets 4, 9 there is interposed a vibration damping material 13, e.g. a rubber gasket. The damping material 13 prevents the transmission of vibrations from the loudspeakers to the main cabinet.

The rubber gasket 13 has a circular section and is accommodated in a half circular groove 14 in the main cabinet 4. The front end 16 of the loudspeaker cabinet 9 is also provided with another half circular groove 17 so that the rubber gasket 13 is securely held in the grooves 14 and 17. Protrusions 18 prolong the front wall 6 and the back wall 7 of the main cabinet 4. The loudspeaker cabinet closely fits between one protrusion 18 of the front wall 6 and back wall 7 as can be seen in FIG. 2*b*. Therefore, there is no visible gap between the main cabinet 4 and the loudspeaker cabinet 9. The securing means connecting the main cabinet 4 and the loudspeaker cabinet 9 are not shown in the drawing and are of conventional type like screws, clips, glue, etc. The securing means are arranged such that it is not possible for the user to detach the loudspeaker cabinet 9 from the main cabinet 4.

The cross section of the rubber gasket can have a different shape as shown in FIG. 2*c*. Depending on the need to avoid sound leakage and/or need to educe cabinet vibrations the rubber gasket 13 can be mounted or not in a particular type of cabinet.

If the reproduced sound has a high volume and contains low frequencies excessive vibrations could disturb the normal operation of a CD player that is built into the main cabinet. The vibration damping rubber gasket 13 reduces the transfer of vibrations generated by the loudspeakers to the main cabinet. Simultaneous the rubber gasket 13 improves the sound quality as such due to its capability to dampen parasitic vibrations.

Figure 3A:
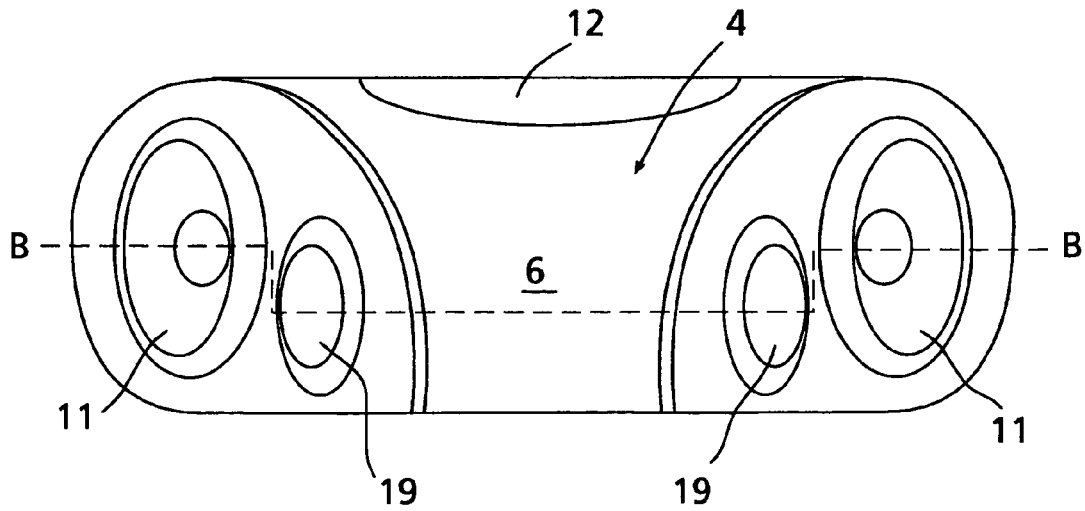
FIG. 3*a* a second audio device according to the invention.
Figure 3B:
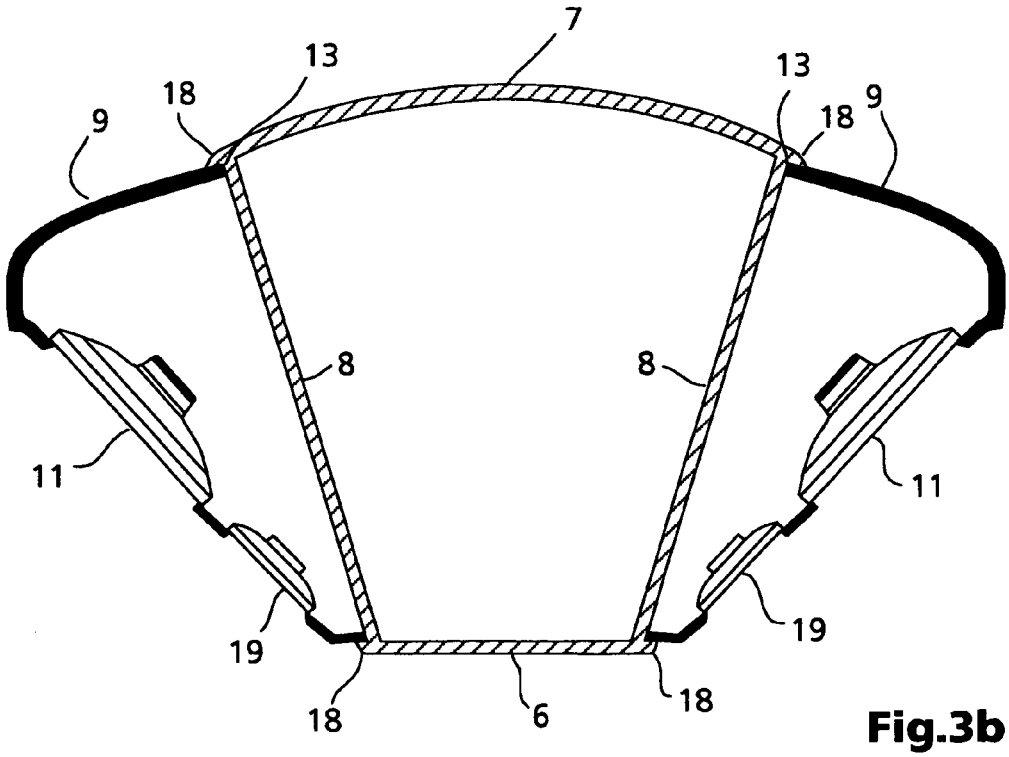
FIG. 3*b* the audio device of FIG. 3*a* in a sectional view.

FIGS. 3*a* and 3*b* display in a different scale another type of a portable audio device according to the present invention. The main cabinet 4 of the first and second embodiment of the invention should have the same size and shape whereas the loudspeaker cabinets are quite different. Compared to the first embodiment shown in FIGS. 2*a* and 2*b* each loudspeaker cabinet 9 houses one additional loudspeaker 19. Therefore, the second embodiment shown in FIGS. 3*a* and 3*b* exhibits a completely different outlook apart from the different sound characteristics.

It is evident that the outlook or design of an audio device can be changed or adapted to different market requirements without changing the number or type of loudspeakers.

What is claimed is:

1. A cabinet for an electronic device equipped with a loudspeaker for audio reproduction wherein said cabinet comprises a first cabinet for housing electrical and mechanical components of the electronic device and having a first wall and a second wall, characterized in that the first cabinet has a confining area for connecting the first wall and the second wall and for accommodating a separate second cabinet for said loudspeaker, wherein a sidewall of the second cabinet is formed to follow the shape of the confining area, and wherein the second cabinet is connected to the first cabinet in a non-detachable manner.

2. The cabinet according to claim 1 characterized in that a vibration damping means is arranged between the first cabinet and the second cabinet.

3. The cabinet according to claim 1 characterized in that inside the second cabinet, electronic circuitry is arranged.

4. The cabinet according to claim 1 characterized in that the first cabinet is provided with urging means pressing the second cabinet against the first cabinet.

5. The cabinet according to claim 4 characterized in that said urging means are arranged such that the second cabinet is pressed against a vibration damping means.

6. The cabinet according to claim 1, characterized in that the confining area of the first cabinet has substantially no openings.

7. The cabinet according to claim 1, characterized in that the first cabinet has protrusions at least partly surrounding the confining area for accommodating the second cabinet and vibration damping means.

* * * * *